United States Patent [19]

Kunz

[11] Patent Number: 4,718,261

[45] Date of Patent: Jan. 12, 1988

[54] SAFETY ARMATURE FOR A DOOR LOCK

[76] Inventor: Manfred Kunz, Grussdorfstr. 8, D-1000 Berlin 27, Fed. Rep. of Germany

[21] Appl. No.: 899,490

[22] Filed: Aug. 22, 1986

[30] Foreign Application Priority Data

Aug. 24, 1985 [DE] Fed. Rep. of Germany ..... 3530620

[51] Int. Cl.[4] ..... E05B 17/14

[52] U.S. Cl. ..... 70/428; 70/27 C

[58] Field of Search ..... 70/27 C, 423, 424–428, 70/455

[56] References Cited

U.S. PATENT DOCUMENTS 2,883,849 4/1959 Lorenzo ..... 70/427

3,552,159 1/1971 Craig ..... 70/27 C

*Primary Examiner*—Robert L. Wolfe

*Attorney, Agent, or Firm*—McGlew and Tuttle

[57] ABSTRACT

A safety armature for a cylinder having a key aperture or keyway, comprises a safety element which is in the form of a magnetically encodeable closure which can be opened by a magnetically coded disk and, which, in its locked position, covers the key aperture or keyway. The magnetically codeable closure may either be a magnetically encodeable padlock having a steel shackle which is held between guide disks of a guide element on the safety armature, or a solidly mounted mounting with a slide unit which is movable on the mounting and that can be latched by means of the magnetically encodeable enclosure.

3 Claims, 7 Drawing Figures

SAFETY ARMATURE FOR A DOOR LOCK

The invention relates to a safety armature for a door lock, particularly a cylinder lock, with a safety element for the key aperture or keyway, respectively.

In conventional safety armatures for a door lock, particularly a cylinder lock, the key aperture or keyway, respectively, is visible from the outside and thus freely accessible. By introducing foreign bodies into the key aperture or keyway, respectively, the door lock, particularly a cylinder lock, can be rendered inoperative. Also, through the introduction of an adhesive, the keyway of cylinder lock, in particular, can be made unserviceable. The result is that the door lock, particularly a cylinder lock, is irreparably destroyed, since after the introduction of foreign bodies or adhesive into the keyway, insertion of the key is no longer possible. Inasmuch as foreign bodies cannot be removed from the complexly constructed cylinder lock, and since an adhesive cannot be eliminated from the cylinder lock, it is necessary to bore out such a cylinder lock and to replace it by a new cylinder lock.

Just recently, the number of cases has grown in which particularly the keyways of cylinder locks have been rendered inoperative by unknown third parties in the manner described above. For this reason, protective rosettes have already been arranged on door locks, particularly on cylinder locks, which are pivoted in front of the key apertures or keyways, respectively, making them invisible at first view. Yet simple protective rosettes can be swung away by a third party, too, so that the key apertures and/or keyways again become visible and freely accessible. Therefore, locks for such protective rosettes have also come into use. But since these locks themselves also have key apertures and/or keyways, the problem described above has thereby merely been shifted to the locks of the protective rosettes.

It is therefore the object of the invention to create a safety armature for a door lock, in particular for a cylinder lock, with a safety element for the key aperture and/or keyway, whereby on the one hand, the safety element is to make the key aperture and/or keyway invisible and inaccessible to third parties, and, on the other hand, be lockable without a key aperture and/or keyway, without unauthorized third parties being able to open and/or remove the safety element.

To solve this problem, the invention provides that the safety element be in the form of a magnetically encodable closure which in the locking position covers the key aperture and/or keyway making them inaccessible and which is mechanically latched and which after magnetic unlatching can be moved into the open position by means of a coded magnetic plate that can be applied to the coding side of the closure, and unblocks the opening of the key aperture and/or keyway. On the one hand, such a safety element secures the key aperture and/or the keyway and makes it invisible and inaccessible to unauthorized third parties. On the other hand, such a safety element has no key aperture or keyway of its own, so that manipulating the safety element of the invention by unauthorized third parties with the aim of rendering the door lock and/or cylinder lock inoperative becomes impossible. The safety element, which according to the invention is in the form of a magnetically encodable closure, does not itself have any key aperture and/or keyway and thus cannot be rendered inoperative through the insertion of foreign bodies or through the introduction of adhesives. The magnetically encodable closure, in the locking position, covers the opening of the key aperture and/or keyway making them inaccessible to unauthorized third parties, and is latched mechanically. After the magnetic unlatching of the mechanical locking mechanism by means of a coded magnetic disk that can be applied to the coding side of the closure, the latter can be moved into the open position and thus again unblocks the opening of the key aperture and/or keyway.

Magnetically encodable closures are per se known. In these, a lock bolt is latched by means of several pins which can be brought into alignment by magnets of varying intensity, so that the lock bolt is released. The magnets of varying intensity are situated on the coded magnetic disk which must be applied to the coding side of the closure, in order to open the closure.

In one specific embodiment, the closure is a magnetically encodable padlock that is provided with a steel shackle, and the armature is provided with a locking and guide element for the padlock and its steel shackle. This embodiment is suitable for retrofitting already existing safety armatures for door locks, in particular for cylinder locks. In the additional, preferred specific embodiment, the armature is formed by a solidly attachable mounting and a sliding unit movable on it and lockable by means of the magnetically encodable closure, with the solidly attachable mounting having an opening within the range of movement of the slidable unit that exposes the key aperture and/or keyway. This specific embodiment of the safety armature according to the invention displays a high degree of security against intervention on the part of unauthorized third parties, and is particularly suitable for securing the cylinder locks of commercial buildings, such as banks, industrial structures and the like.

The invention is illustrated in detail below with aid of two specific embodiments shown in the drawings.

Figure 1:
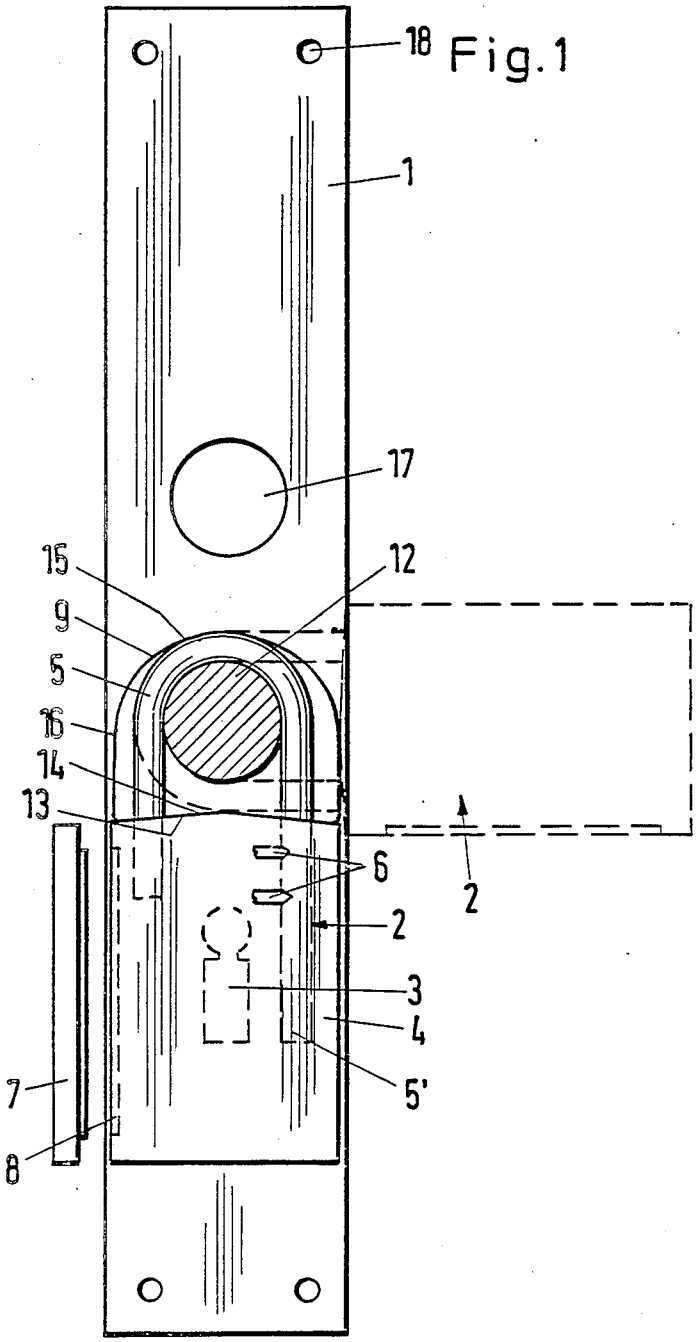
FIG. 1 shows a plan view of the first embodiment of the safety armature.

The first embodiment comprises a safety armature 1 for a door lock with a safety element 2 for the key aperture 3, with the safety element 2 designed as a magnetically encodable closure in the form of a magnetically encodable padlock 4 which latter is provided with a steel shackle 5. The magnetically encodable padlock 4, in the locking position shown in FIG. 1 by solid lines, inaccessibly covers the opening of key aperture 3 and is mechanically bolted in that several pins 6 under spring tension engage the lock bolt 5' of the padlock 4, which forms an extension of the steel shackle inserted in the padlock 4. The spring-loaded pins 6 can be brought into alignment by means of magnets of varying intensity not shown in detail, so that the pins 6 release the lock bolt 5' and the padlock 4 can be opened. The magnets of varying intensity are arranged on a coded magnetic disk 7 which can be applied to the coding side 8 of the padlock 4. After the magnetic unlocking, the padlock 4 is moved into the open position, shown by broken lines in FIG. 1, and thus uncovers the opening of the key aperture 3.

For locking and guiding the padlock 4 with the steel shackle 5, a locking and guiding element 9 is firmly mounted on the safety armature 1. It is formed by two segment-type guide disks 10, 11 and a circular guide disk for the steel shackle 5 situated between them. The guide disks 10, 11 have on their bottom surface a slightly inward, V-shaped locking surface 13 for the correspondingly shaped locking edge 14 of the padlock 4, and on the top surface, curve-shaped, bent guide surfaces 15 which between them are connected by stop surfaces 16 for the open position of the padlock 4. As shown in FIG. 1, from which the upper guide disk 11 has been omitted, the steel shackle 5 encloses in the locking position of padlock 4 the circular guide disk 12, with the slightly roof-shaped locking edge 14 of the body of padlock 14 adjoining the locking surfaces 13 of the two guide disks 10, 11. The padlock 4 is thus firmly locked at the pins 6 that are under spring tension and are engaged in the lock bolt 5', and it thus closes the opening of the key aperture 3 rendering it inaccessible to unauthorized third parties.

By applying the magnetic disk 7 to the coding side 8 of the padlock 4, the pins 6 are brought into alignment by magnets of varying intensity of the magnetic disk 7, so that the lock bolt 5' is released. The body of the padlock 4 can thus be pulled downward, according to illustration shown in FIG. 1, and subsequently, by means of the steel shackle 5, it can be brought into the open position, shown in broken lines in FIG. 1, around the circular guide disk 12; in this position, the locking edge 14 adjoins the lateral surfaces 16 of the guide disks 10, 11. The key aperture 3 is thus made freely accessible.

By swinging back the padlock 4 into the position shown in FIG. 1, the pins 6, under spring action, again automatically engage the lock bolt 5', so that the padlock 4 again securely locks the key aperture 3 against unauthorized third parties.

Figure 2:
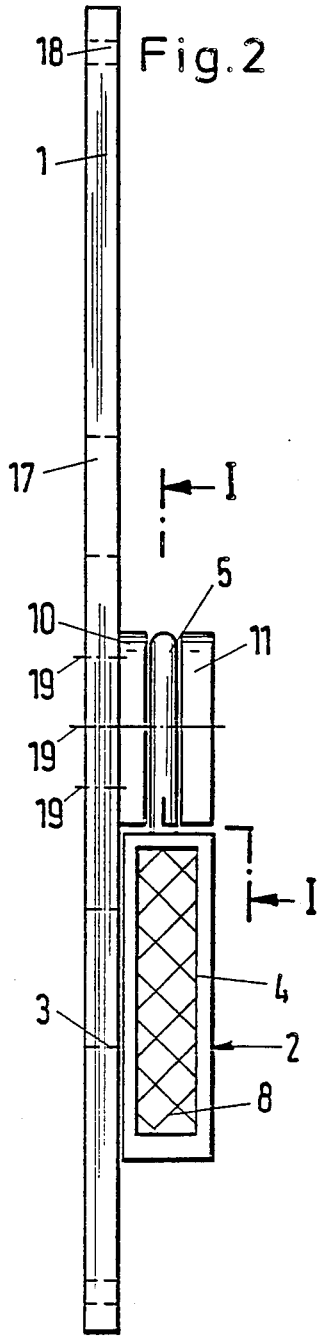
FIG. 2 shows a side view.

The latch opening 17 and borings 18 for the fastening screws of the safety armature 1 are also shown in FIGS. 1 and 2. The segment-type guide disks 10, 11 and the circular guide disk 12 are attached to the safety armature 1 by means of connecting elements in the form of screws and/or pins that are not shown in detail but are indicated by reference number 19 in FIG. 2. The magnetic disk 7 is a separate component.

In the second specific embodiment shown in FIGS. 3 through 7, the safety armature 20 for a door lock, particularly for a cylinder lock, is formed by a mounting 21 firmly mounted on the door and by a sliding unit 22 movable on said mounting, which can be locked to the firmly mountable mounting 21 by means of a magnetically encodable closure 23. The firmly attached mounting 21 has, within the range of movement of the sliding unit 22, an opening 24 revealing the key aperture and/or keyway not shown in greater detail.

The firmly attachable mounting 21 comprises a base plate 25 which on a partial section has a firmly mounted support 40 for two guide rods 26, 27 for the sliding unit 22 arranged in parallel above the free portion of the base plate 25. The support 40 consists of a solid metal block which is firmly connected with the base plate 25 and which receives the two guide rods 26, 27 firmly fixed in blind-end bores 28. The base plate 25 is attached to the door by fixing means not shown in further detail and which are not accessible from the outside in the closed state of safety armature 20. The door lock to be secured is situated in the door, namely below the opening 24 of the base plate 25. The free part of the base plate 25 has the opening 24 for the key aperture and/or keyway and is furthermore provided at its lateral longitudinal edges with guide rails 29 for the sliding unit 22, as can be gathered from the sectional drawing in FIG. 5, in particular.

The sliding unit 22 has two parallel through-holes 30 for the guide rods 26, 27. At its bottom side, the sliding unit 22 is provided with guide channels 31 receiving the guide rails 29 of the base plate 25. An end stop not shown in further detail is also provided to limit the opening motion of the sliding unit 22 along the base plate.

In addition, the sliding unit 22 is provided with a receiving opening 32 for the magnetically encodable closure 23. The latter is comprised of a cuboidal metal body with through-holes for the two guide rods 26, 27 and an inner, spring-loaded locking pin 33 which, in the locking position according to FIG. 3, engages a locking notch 34 in the guide rod 26. On the top side of the closure 23, passed thruogh an opening 39 in the upper side of the sliding unit 22, a swiveling actuating element 35 is provided for closure 23, which can be actuated by means of an encoded magnetic disk 36 and which can be unlatched by a rotation of less than 90°.

Figure 3:
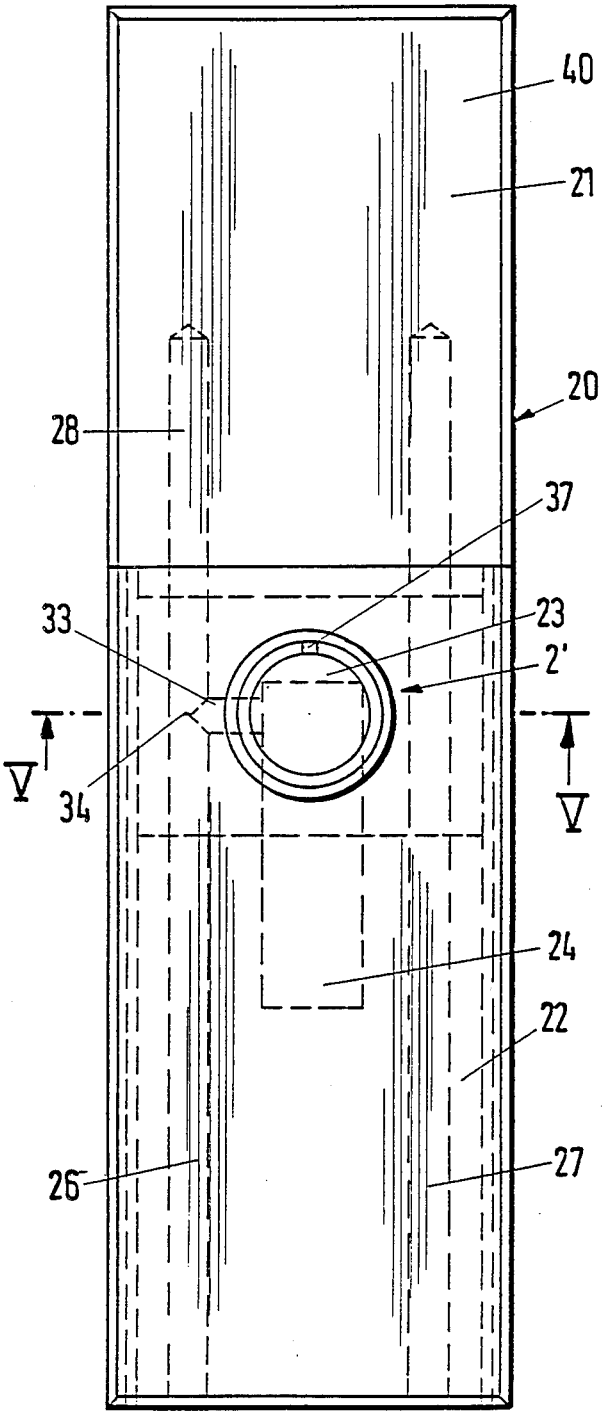
FIG. 3 shows a plan view of the second embodiment of the safety armature in the locking position.
Figure 4:
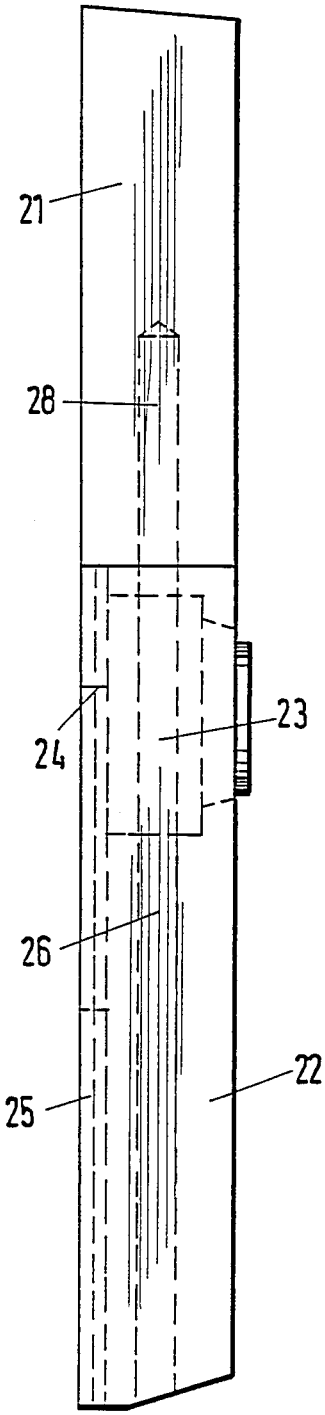
FIG. 4 shows a side view thereto.
Figure 5:
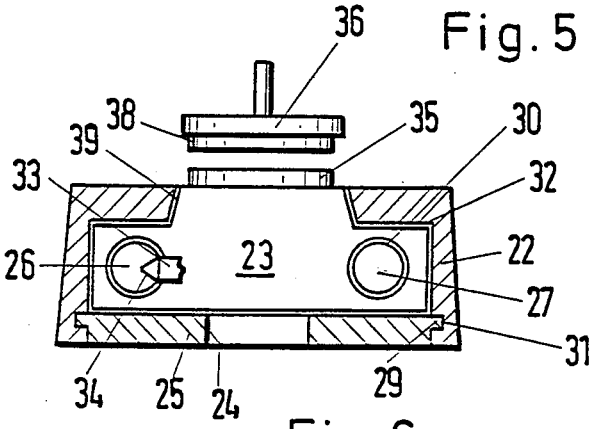
FIG. 5 shows a section along line V—V in FIG. 3.

In the locking position illustrated in FIG. 3, the locking pin 33 is locked in the locking notch 34 of the guide rod 26, so that the sliding unit 22 adjoins the support 40 for the guide rods 26, 27 and thus closes the opening for the key aperture and/or keyway. The actuating element 35 for the closure 23 with an actuating notch 37 is in the "12 o'clock" position according to FIG. 3, which indicates that the safety locking is in place.

Figure 6:
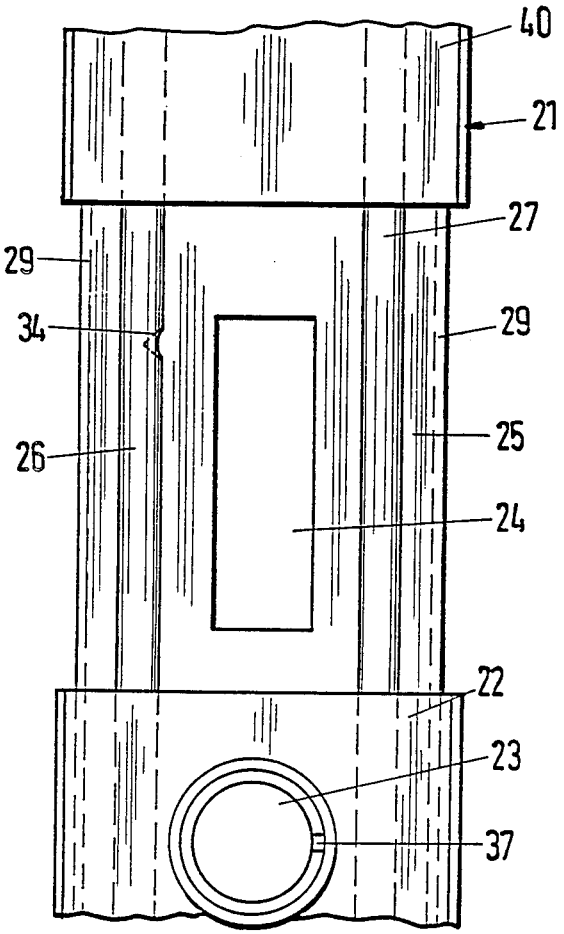
FIG. 6 shows a partial plan view of the safety armature according to the second embodiment, in the open position.
Figure 7:
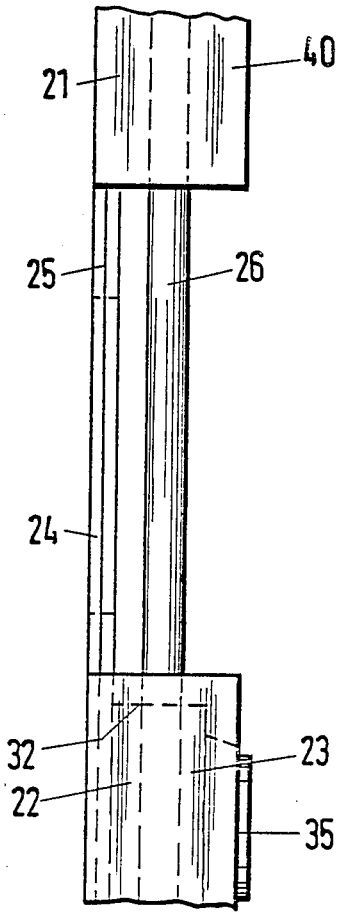
FIG. 7 shows a side view thereto.

By applying the magnetic disk 36 which is provided with an actuating lug 38, the actuating element 35 can be turned clockwise to approximately the "3 o'clock" position according to FIG. 6, by which the locking pin 33 is unlatched from the locking notch 34 of guide rod 26. The sliding unit 22 can be pulled away from the support 40 along the base plate 25, namely until the opening 24 is completely uncovered, as shown in FIGS. 6 and 7. In this open position, the key aperture and/or keyway of the door lock, particularly of the cylinder lock, situated underneath the opening 24, can then be actuated. The magnetic disk 36 is also a separate component, to be treated and to be used like a key. After the sliding unit 22 is pushed back into the position according to FIG. 3 and after the renewed locking of the closure 23 in the position shown in FIG. 3, the opening 24 is again completely inaccessible.

Neither the padlock 4 according to the first specific embodiment illustrated in FIGS. 1 and 2, which is known under the trademark "Genii," nor the closure 23 according to the second specific embodiment illustrated in FIGS. 3 through 7, has any opening or the like, into which foreign bodies could be introduced or which could be glued closed, so that accessibility to the actual key aperture and/or keyway would always be assured to authorized persons, provided they have the necessary magnetic disks 7 resp. 36 at hand, which are encoded for the respective magnetic closures of padlock 4 respectively closure 23.

All the essential parts are of steel, particularly high-grade stainless steel.

SUMMARY

A safety armature for a door lock, particularly a cylinder lock, is to be created with a safety element 2 for the keyway 3, in order to prevent manipulation through the introduction of foreign bodies or adhesives into the keyway 3, which would render the door lock inoperative. The invention provides that the safety element 2 be in the form of a magnetically encodeable closure 4 which, in the locking position, inaccessibly covers the opening of the keyway 3 and which is locked mechanically, and which, after being unlatched by means of a coded magnetic disk 7 that is applied to the coding side 8 of the closure 4, can be moved into the open position and uncovers the opening of the keyway 3. (FIG. 1).

I claim:

1. Safety armature for a door lock, in particular a cylinder lock, with a safety element for the key aperture and/or the keyway, characterized in that the safety element is in the form of a magnetically encodeable closure which, in the locked position, inaccessibly covers the opening of the key aperture and/or keyway and is mechanically latched, and which, after a magnetic unlatching by means of a coded magnetic disc applied to the coding side of the closure, can be moved into the open position and unblocks the opening of the key aperture and/or keyway, the closure comprising a magnetically encodeable padlock (4) that is provided with a steel shackle (5) and the safety armature (1) being firmly connected to a locking and guide element (9) which is formed by two segmental guide disks (10,11) for the locking bolt edge (14) of the padlock (4) and a circular guide disk (12) for the steel shackle (5) mounted between them.

2. Safety armature for a door lock, in particular a cylinder lock, with a safety element for the key aperture and/or the keyway, characterized in that the safety element is in the form of a magnetically encodable closure which, in the locked position, inaccessibly covers the opening of the key aperture and/or keyway and is mechanically latched, and which, after a magnetic unlatching by menas of a coded magnetic disc applied to the coding side of the closure can be moved into the open position and unblocks the opening of the key aperture and/or keyway, the safety armature (20) comprising a solidly mountable mounting (21) and a sliding unit (22) that is movable on the mounting and that can be latched by means of the magnetically encodable closure (23), with the solidly mountable mounting (21) having an opening (24) within the range of movement of the sliding unit (22), which unblocks the key aperture and/or keyway.

3. Safety armature according to claim 2, characterized by that the solidly mountable mounting (21) comprises a base plate (25) which on a portion thereof has a solidly mounted support (40) for two guide rods (26, 27) for the sliding unit (22) arranged in parallel above the free portion of the base plate (25) and which in the free portion has the opening (24) for the key aperture and/or keyway and lateral guide rails (29) for the sliding unit (22), and that the sliding unit (22) has two parallel through-holes (30) for the guide rods (26, 27) and lateral guide channels (31) for the lateral guide rails (29) of the base plate (25) and, in addition, is provided with a receiving opening (32) for the magnetically encodable closure (23), the mechanical locking pin (33) of which engages a locking notch (34) of one guide rod (26) in the locking position and which can be unlatched by means of a coded magnetic disk (36).

* * * * *